US010876326B2

(12) United States Patent
Barmscheidt

(10) Patent No.: US 10,876,326 B2
(45) Date of Patent: Dec. 29, 2020

(54) MOTOR VEHICLE DOOR LOCK

(71) Applicant: Kiekert AG, Heiligenhaus (DE)

(72) Inventor: Christian Barmscheidt, Duisburg (DE)

(73) Assignee: Kiekert AG, Heiligenhaus (DE)

( * ) Notice: Subject to any disclaimer, the term of this patent is extended or adjusted under 35 U.S.C. 154(b) by 547 days.

(21) Appl. No.: 15/578,937

(22) PCT Filed: May 11, 2016

(86) PCT No.: PCT/DE2016/100213

§ 371 (c)(1),
(2) Date: May 18, 2018

(87) PCT Pub. No.: WO2016/192707

PCT Pub. Date: Dec. 8, 2016

(65) Prior Publication Data

US 2018/0328086 A1 Nov. 15, 2018

(30) Foreign Application Priority Data

Jun. 2, 2015 (DE) ..... 10 2015 108 738

(51) Int. Cl.
*E05B 77/26* (2014.01)
*E05B 81/14* (2014.01)
*E05B 81/66* (2014.01)
(Continued)

(52) U.S. Cl.
CPC ..... *E05B 77/26* (2013.01); *E05B 77/22* (2013.01); *E05B 77/54* (2013.01); *E05B 81/14* (2013.01);
(Continued)

(58) Field of Classification Search
CPC ..... E05B 77/26; E05B 81/06; E05B 81/64; E05B 81/20; E05B 77/28; E05B 77/287; Y10T 292/1082; Y10T 292/1047
See application file for complete search history.

(56) References Cited

U.S. PATENT DOCUMENTS 6,075,460 A * 6/2000 Minissale ..... B60Q 1/00 340/12.22
6,189,406 B1 * 2/2001 Kapes ..... E05B 79/20 29/434
(Continued)

FOREIGN PATENT DOCUMENTS

DE 20307347 U1 9/2004
DE 202007016719 U1 4/2009
(Continued)

OTHER PUBLICATIONS

International Search Report for corresponding Patent Application No. PCT/DE2016/100213 dated Oct. 6, 2016.

*Primary Examiner* — Mark A Williams
(74) *Attorney, Agent, or Firm* — Renner, Otto, Boisselle & Sklar, LLP

(57) ABSTRACT

The invention relates to a motor vehicle door lock, comprising a locking mechanism (22), an electric drive (26) which allows the locking mechanism (22) to be unlocked, a child safety device (29) with a child safety sensor (31), the electric drive (26) can be activated or not activated depending on the switch position of the child safety sensor (31), and a closing drive (42) which transfers the locking mechanism (22) from a pre-locked position into a main locked position. A locking mechanism sensor (25) is associated with the locking mechanism (22) and depending on the switch position of the locking mechanism sensor (25), the drive (26) can be activated or not activated.

14 Claims, 4 Drawing Sheets

Figure 1:
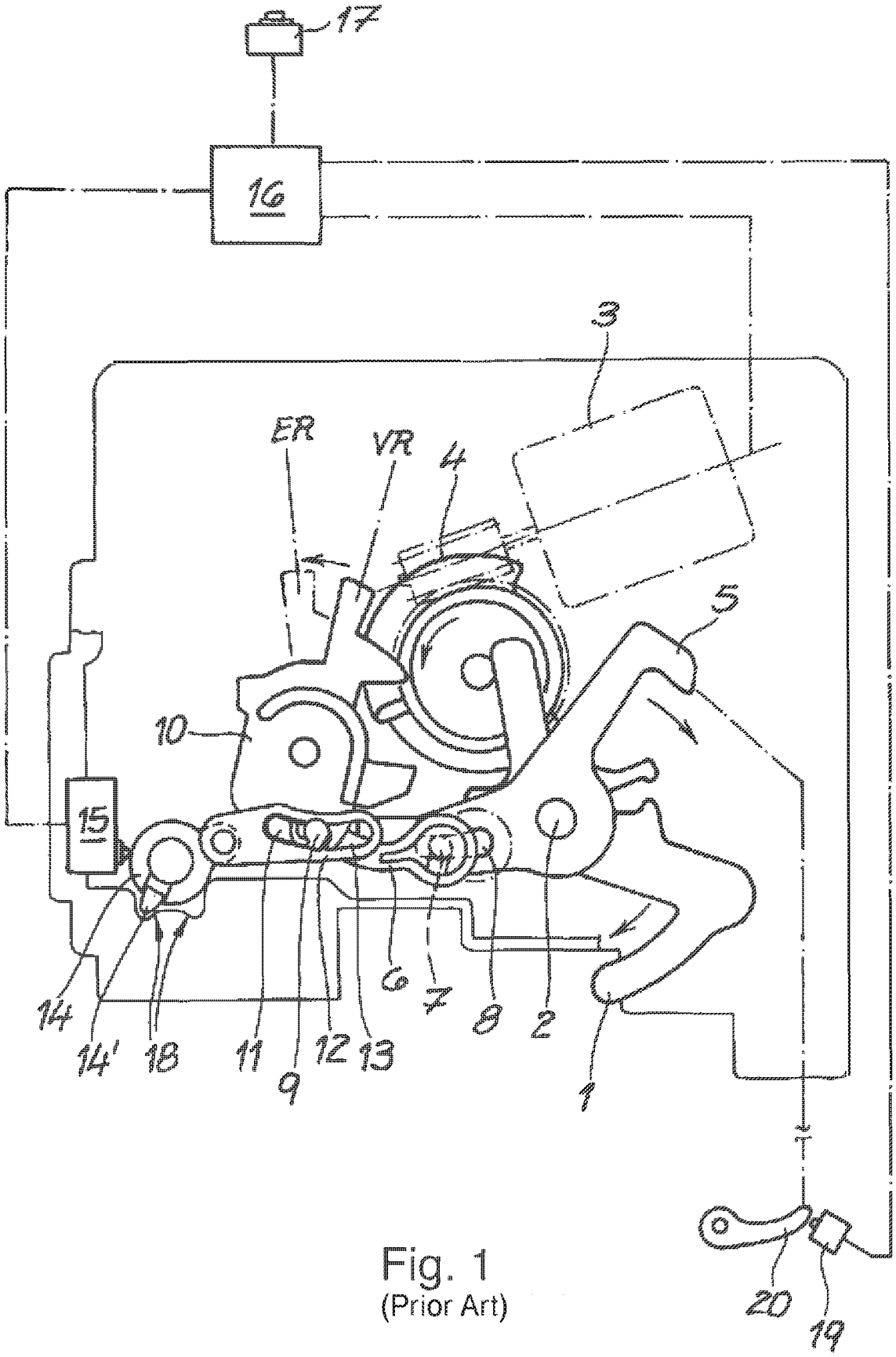
Fig. 1 (Prior Art)

(51) Int. Cl.

| | |
|---|---|
| ***E05B 81/20*** | (2014.01) |
| ***E05B 77/22*** | (2014.01) |
| ***E05B 77/54*** | (2014.01) |
| *E05B 81/64* | (2014.01) |
| *E05B 85/24* | (2014.01) |

(52) U.S. Cl.
CPC ..... *E05B 81/20* (2013.01); *E05B 81/66* (2013.01); *E05B 81/64* (2013.01); *E05B 85/243* (2013.01)

(56) References Cited

U.S. PATENT DOCUMENTS

| | | | | |
|---|---|---|---|---|
| 6,276,743 | B1 * | 8/2001 | Jyawook | B60J 5/06 296/155 |
| 6,323,565 | B1 * | 11/2001 | Williams, Jr. | E05B 77/48 307/10.1 |
| 6,435,600 | B1 * | 8/2002 | Long | B60J 5/06 296/155 |
| 6,764,113 | B1 * | 7/2004 | Cetnar | E05B 81/06 292/201 |
| 2003/0080569 | A1 | 5/2003 | Raymond | |
| 2010/0117379 | A1 * | 5/2010 | Mitchell | E05B 81/14 292/216 |
| 2015/0048632 | A1 | 2/2015 | Menke | |
| 2019/0017301 | A1 * | 1/2019 | Cumbo | E05B 81/72 |

FOREIGN PATENT DOCUMENTS

| | | | |
|---|---|---|---|
| DE | 202010009333 | U1 | 10/2011 |
| DE | 20 2012 003171 | U1 | 7/2013 |
| DE | 10 2012 003 743 | A1 | 8/2013 |
| DE | 102015108738 | A1 | 12/2016 |
| GB | 2 320 943 | A | 7/1998 |
| JP | 2001509849 | A | 7/2001 |
| JP | 2002129812 | A | 5/2002 |
| JP | 2010084321 | A | 4/2010 |
| JP | 2012241346 | A | 12/2012 |
| WO | 2013143522 | A1 | 10/2013 |

* cited by examiner

MOTOR VEHICLE DOOR LOCK

The invention relates to a motor vehicle latch having a locking mechanism, an electrical drive, whereby the locking mechanism is unlocked by means of the electrical drive, a child safety lock device with a child safety sensor, whereby according to the switching position of the child safety sensor the electrical drive can be activated or not activated and a cinching drive with which the locking mechanism is transferable from a pre-ratchet position into a main ratchet position.

An increasing number of functions are used in contemporary motor vehicles which facilitate operation and increase convenience. For example, it is known to use locking systems on lateral doors and/or tailgates and/or sliding doors which independently execute independent latching of the flaps or doors. To this end, the flaps or doors are closed following a closure of the door into a first ratchet position which is described as a pre-ratchet position hereafter. From this pre-ratchet position, an electrical drive usually acts on the latching system and moves the door into the final cinching position which is described as a main ratchet position hereafter in relation to the motor vehicle door latch. Transfer of the door or flap into the main ratchet position is also described as cinching. In addition to the pure cinching of a pre-ratchet into a main ratchet, it is also known to use drive systems to open and/or close the lateral door. The doors are usually operated by means of a sensor and can be completely opened and closed.

In all of these latching systems, further functions can be used which increase passenger safety, for example. A known safety system for passengers is a child lock. A child lock encompasses the function that a child or person, usually situated on a front seat, cannot open the motor vehicle door, i.e. that even if the person in the motor vehicle attempts to alight, the internal operating lever is disabled.

In addition to the cinching and safety device, latches can be equipped with electrical opening systems. Electrical opening describes the function in which, while the operator manually operates the internal operating lever or external door handle, actual opening of the latch occurs however by means of a, usually, electrical drive. An external operating lever can, for example, only operate a transducer, such as a switch, so that an electrical signal is generated, whereby the drive can be activated by means of a control unit. Alternatively, the external operating lever can be mechanically connected to an operating lever in the motor vehicle latch and accomplish a pivoting movement, for example. The operating lever can then in turn operate a switching means or a transducer which, in turn, conducts a signal to the control unit so that the drive can be activated in turn. Electrical opening thus describes an opening triggered by means of a drive, i.e. unlocking of the locking mechanism. The electrical drive can be connected to a gearbox and a drive disk which then interacts with a triggering lever and the triggering lever mechanically unlocks the locking mechanism.

A motor vehicle latch with an electrical opening mechanism is known from DE 10 2012 003 743 A1. An electrical drive consisting of a motor, a wormgear and a drive pulley can actuate a triggering lever during operation, whereby the triggering lever acts directly on the pawl and the locking mechanism comprising a catch and a pawl is unlocked. An operating lever which can be an internal operating lever or an external operating lever, for example, interacts after operation by means of the external handle or the internal door handle with a transducer which, in turn, activates the electrical drive by means of a control unit. The motor vehicle latch is in the bolted state, i.e. the latch is opened electrically without a mechanical operative connection occurring between the operating lever and the triggering lever. The operating lever and the triggering lever are mechanically disconnected by means of the bolting device. Only where emergency operation becomes necessary, for example during a power drop, the electrical drive travels into a direction opposite to the opening direction and unlocks the motor vehicle latch. In this case, an operator is then able to mechanically operate the operating lever and engage the triggering lever with the locking mechanism so that the flap, door or sliding door can be opened.

From DE 20 2012 003 171 U1 a further electrically opening motor vehicle latch is known. In addition to electrical opening which also consists of a mechanism comprising an electromotor wormgear and a drive pulley this latch has a child lock. The latch is usually in the bolted state and an operating lever can be operated by means of a handle, such as an internal door handle or an external door handle. The operating lever acts on an opening switch which initializes the electrical drive by means of a control unit. The operating lever and triggering lever are disconnected. In the case of an engaged child lock, a child lock sensor is activated and the control unit evaluates the signal of the child lock sensor during activation of an internal door handle. An opening switch is operated during operation of the internal operating lever by the internal door handle. If the child lock sensor is also activated, the door can thus not be opened. Mechanical and also electrical opening of the motor vehicle door latch is thus prevented.

Starting from the known state of the art, the task is posed to improve a known motor vehicle latch. In particular, the task is set of simplifying the construction without reducing the functional scopes or allowing safety-related functions to be omitted. Furthermore, the task is set to provide a cost-effective solution of a simple construction to operate an electrically opening latch.

The task is solved according to the invention by the characteristics of the independent claim. Advantageous designs of the invention are specified in the sub-claims. It is pointed out that the exemplary embodiments described hereafter are not restrictive; instead, any possible variations are possible of the characteristics described in the description and the sub-claims and the Figures.

According to patent claim 1, the task of the invention is solved in that a motor vehicle latch is provided which has a locking mechanism, an electrical drive, whereby the locking mechanism is unlocked by means of the electrical drive, a child safety lock device with a child safety sensor, whereby according to the switching position of the child safety sensor the electrical drive can be activated or not activated and a cinching drive with which the locking mechanism can be transferred from a pre-ratchet position into a main ratchet position and a locking mechanism sensor is assigned to the locking mechanism, whereby according to the switching position of the locking mechanism sensor the drive can be activated or not activated. By using the locking mechanism sensor, the possibility is now created of providing a motor vehicle door latch in which the same functions are provided with a lower number of components without forfeiting safety features. By means of the locking mechanism sensor, a statement can directly be made as to whether the locking mechanism is in a closure position or an opening position. According to the position of the locking mechanism, the locking mechanism sensor can be evaluated and provide a signal for a control unit to enable activation or deactivation of the electrical drive. In particular, by means of the locking mechanism sensor the closure position of the door, flap or sliding door can be determined so that activation of the drive for opening can be enabled.

If a motor vehicle latch is spoken of within the scope of the invention, such latching systems are meant which keep flaps, doors and/or sliding doors, components of the motor vehicle, in their closed position. Such motor vehicle latches encompass a locking mechanism comprising a catch and a pawl.

The locking mechanism can also be equipped with two or more pawls or have a ratchet or blocking lever, for example. Such locking mechanisms are known from the state of the art. Furthermore, the motor vehicle latch according to the invention has an electrical drive which can unlock the locking mechanism. The electrical drive usually operates indirectly but can also operate directly on a triggering lever which then mechanically engages into the locking mechanism and unlocks.

The electrical drive can encompass an electromotor, a wormgear and an output gear, whereby the output gear operates directly on the triggering lever. According to the invention, a child safety device is also provided for which encompasses a child safety sensor. The child safety sensor can be equipped as a switching element or also as a contact-sensitive sensor. According to the switching position of the child safety sensor, a signal is transmitted to a control unit which then in turn activates or does not activate the electrical drive.

The motor vehicle latch according to the invention also has a cinching drive. A locking mechanism can be transferred from a pre-ratchet position into a main ratchet position by means of a cinching drive. A pre-ratchet position is the position of the door, flap or hood in which the door is already closed and is held in position by means of the locking mechanism and in particular in a ratchet position. The motor vehicle door is then transferred from the pre-ratchet position into the main ratchet position by means of a usually electrical drive in which the door is located in the completely closed position.

If the child safety device is switched on or engaged and if the motor vehicle latch is transferred from the pre-ratchet into the main ratchet position by means of the cinching drive, the door should be opened by means of the internal operating lever. The child safety device must be disabled for this purpose. Disabling can occur, for example, by means of an electrical drive. According to the object of the invention, an electrical drive can be dispensed with to deactivate the child safety device. A further signal is available by means of the engagement of the locking mechanism sensor with which a statement is possible regarding the closure position of the door. By the engagement of the locking mechanism sensor activation of the electrical drive can occur to open the door by means of the control unit during an operation of the internal operating lever. A mechanical deactivation of the child safety device is thus not necessary.

In one embodiment of the invention, the position of the locking mechanism in the pre-ratchet and the main ratchet is detectable by means of the locking mechanism sensor If the direct position of the locking mechanism in the pre-ratchet and the main ratchet is detectable by means of the locking mechanism sensor, a control unit can bypass the child safety sensor signal and thus give an operator of the internal operating lever the possibility to open the door or to interrupt a cinching process and to interrupt cinching. By means of the detection of the position of the locking mechanism in a position between the pre-ratchet and main ratchet the operator of the internal operating lever located in the vehicle can give the possibility of also opening an as not yet completely closed lateral door even when the child safety device is engaged. This offers a high degree of safety and simultaneously guarantees that the child safety device in fully available in its function when the door is closed.

Advantageously, the locking mechanism sensor can be arranged on the catch in a further embodiment of the invention. A direct query of the position of the catch entails a high degree of safety. If the catch is located in its end position, i.e. in the position in which the door is completely closed and if exactly this position is queried by means of the locking mechanism sensor, malfunctions can thus be prevented with the greatest possible certainty.

If an operating lever is provided for and if at least an opening switch can be operated by means of the operating lever, a further embodiment of the invention results. An operating lever can be an internal operating lever or also an external operating lever. The operating lever is operated by means of an internal door handle or an external door handle, whereby in the unbolted state the operating lever moves the triggering lever so that the locking mechanism can be unlocked. Advantageously, the operating lever interacts with an opening switch. The internal operating lever and also the external operating lever preferably operate a common opening switch. A further switch upstream from the opening switch can be provided for with which the operating lever comes into contact before reaching the opening switch and which serves to activate the control unit This switch further upstream can thus be described as a wake-up switch. Advantageously thus an internal operating lever and an external operating lever are provided for and with the internal operating lever and the external operating lever at least the opening switch can be operated.

A further advantageous embodiment results when a coupling lever is provided for and if, by means of the coupling lever, the operating lever can be coupled with a triggering lever. The provision of a coupling lever enables the operating lever to be coupled with the triggering lever by a movement of the coupling lever which, for example, can be a pushing movement or a rotational movement or a pivoting movement. The coupling lever can preferably be operated with an electrical drive. The coupling lever can have an operating pin which, for example, engages into grooves of the triggering lever and the operating lever and thus couples the pivotably accommodated levers.

If a bolting lever is provided for and if the coupling lever is movable by means of the bolting lever so that the operating lever can be coupled, a further embodiment of the invention thus results. The operating lever is formed as a pivotably accommodated lever. The internal operating lever, the external operating lever and the triggering lever are preferably accommodated on a common axis. The coupling lever can engage the internal operating lever and/or the external operating lever with the triggering lever by means of a pushing movement according to the position of the coupling lever. The coupling lever is moved by means of an also pivotably accommodated bolting lever. In a first position of the coupling lever the internal operating lever and the external operating lever are coupled with the triggering lever, i.e. mechanically engaged. In this position the external operating lever can be moved by an operation of an external door handle, for example, and the locking mechanism is mechanically and electrically unlocked and the motor vehicle door is thus opened.

In a second position of the coupling lever the external operating lever is disengaged from the triggering lever. In this position, the bolt can be raised by operation of the internal door handle and thus the internal operating lever so that the coupling lever is returned to its original position and the latch can be opened again by means of the external operating lever. In a further third position of the coupling lever neither the external operating lever nor the internal operating lever is engaged with the triggering lever, whereby additionally the internal door handle is disengaged from the engagement in the bolting device. Disengaged hereby means that the bolting cannot be raised even with operation of the internal door handle. This position of the coupling lever is reached by the child safety device. The operating lever can be moved and operates the opening switch. However, a mechanical unbolting of the coupling lever is not possible in this position.

If the child safety device interacts with the coupling lever so that the internal operating lever can be uncoupled by means of the child safety device, a further advantageous embodiment of the invention thus results. By means of the engagement of the child safety device into the coupling lever a structurally beneficial solution is enabled to attain the child safety function. The child safety device preferably consists of a pivotably accommodated child safety element which can preferably be operated externally by the operator by means of a tool, such as a motor vehicle key or a screwdriver.

A child safety sensor interacts with the child safety element which, according to the position of the child safety element, transfers a signal to the control unit so that it is detectable whether the child safety device is activated or deactivated. The child safety device preferably comprises the child safety sensor, the child safety element pivotably accommodated in the motor vehicle door latch and a tappet which, on the one hand, engages with the child safety element and on the other hand with the coupling lever and/or the bolting lever.

In preferred embodiments the internal operating lever and the external operating lever are accommodated coaxially. Furthermore, the internal operating lever and the external operating lever i.e. the operating levers are also accommodated coaxially with the triggering lever.

In an alternative embodiment a control unit is provided for, whereby by means of the control unit the switching positions of the switch can be queried so that the drive can be activated or deactivated. By means of the control unit the different settings are detectable on the motor vehicle latch and the drives can be activated. Thus, the switching position of the sensors and switches is queried by means of the control unit and relevant control signals are conducted to the drive(s). If, for example, the external operating lever operates by means of the external door handle, the external operating lever thus oscillates and activates the wake-up switch and subsequently the opening switch. The control unit thus detects a signal with which the drive can be activated so that the motor vehicle door latch can be unlocked and the door, flap or sliding door can be opened.

Hereinafter the invention is explained in further detail with reference to the attached drawings and flow diagrams on the basis of a preferred embodiment. However, the principle applies that the exemplary embodiment does not restrict the invention but only constitutes an advantageous embodiment. The characteristics depicted can be executed individually or in combination, individually or in combination with other characteristics of the description, as also the patent claims.

Figure 2:
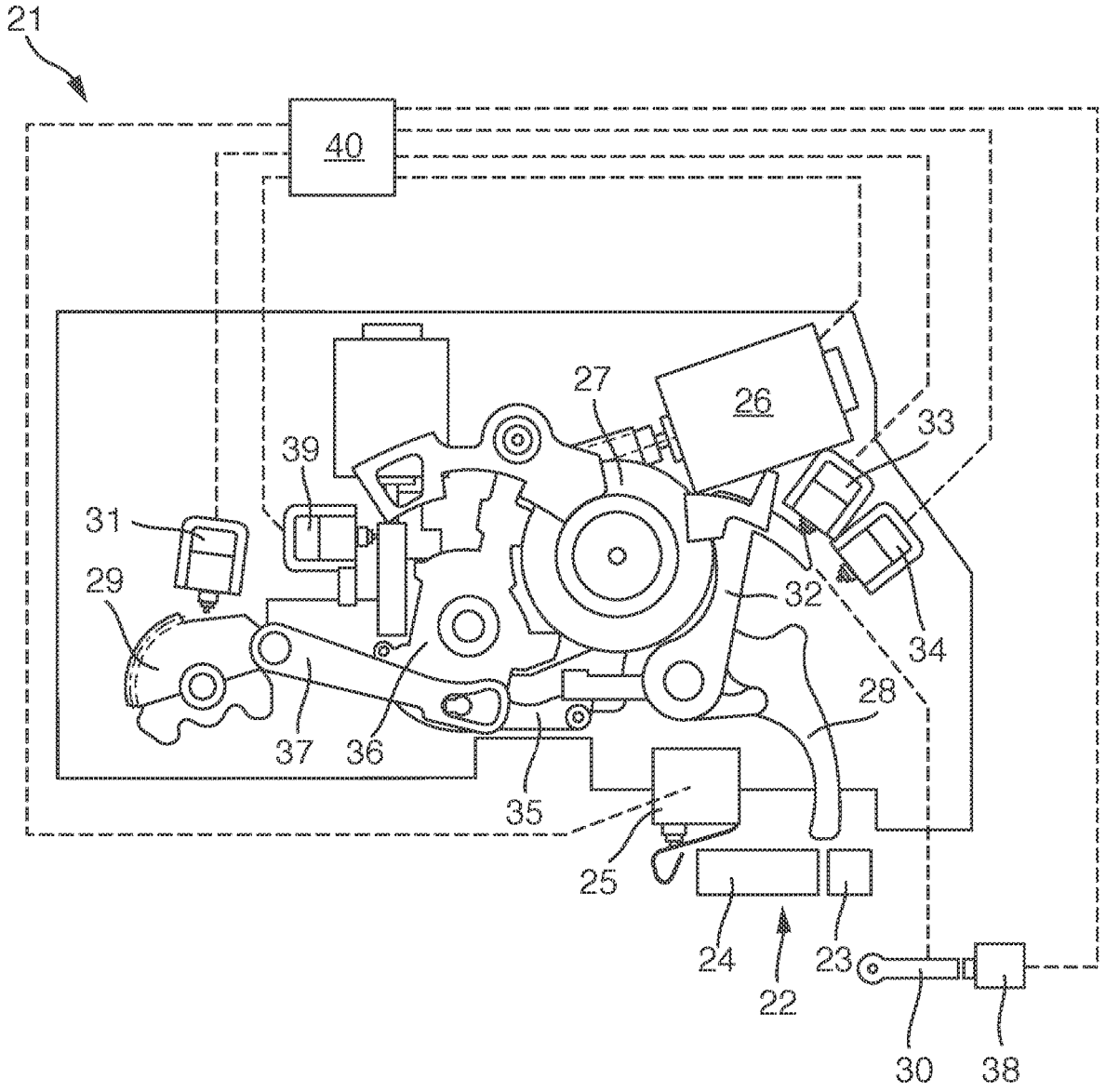
Figure 3:
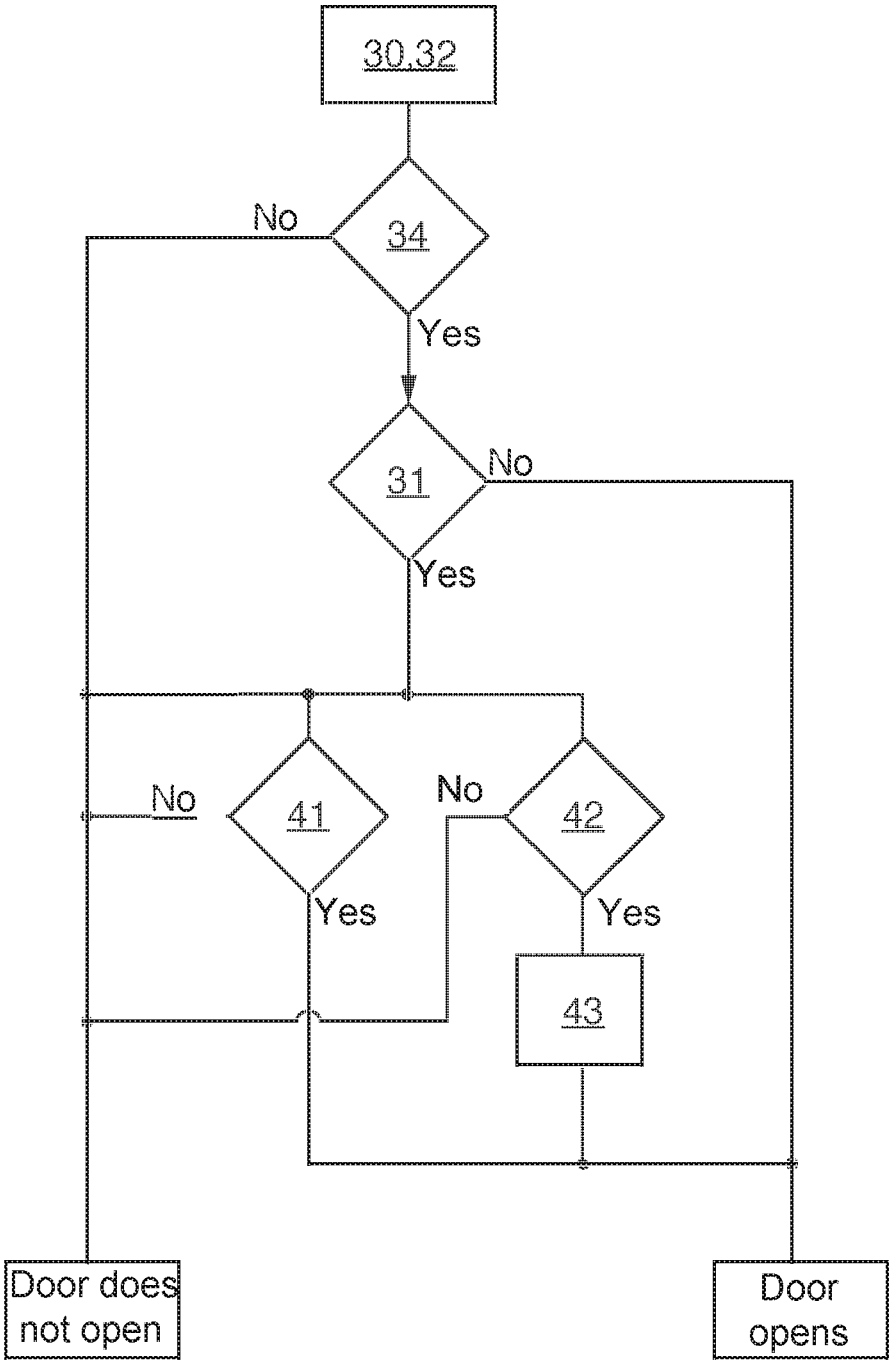
Figure 4:
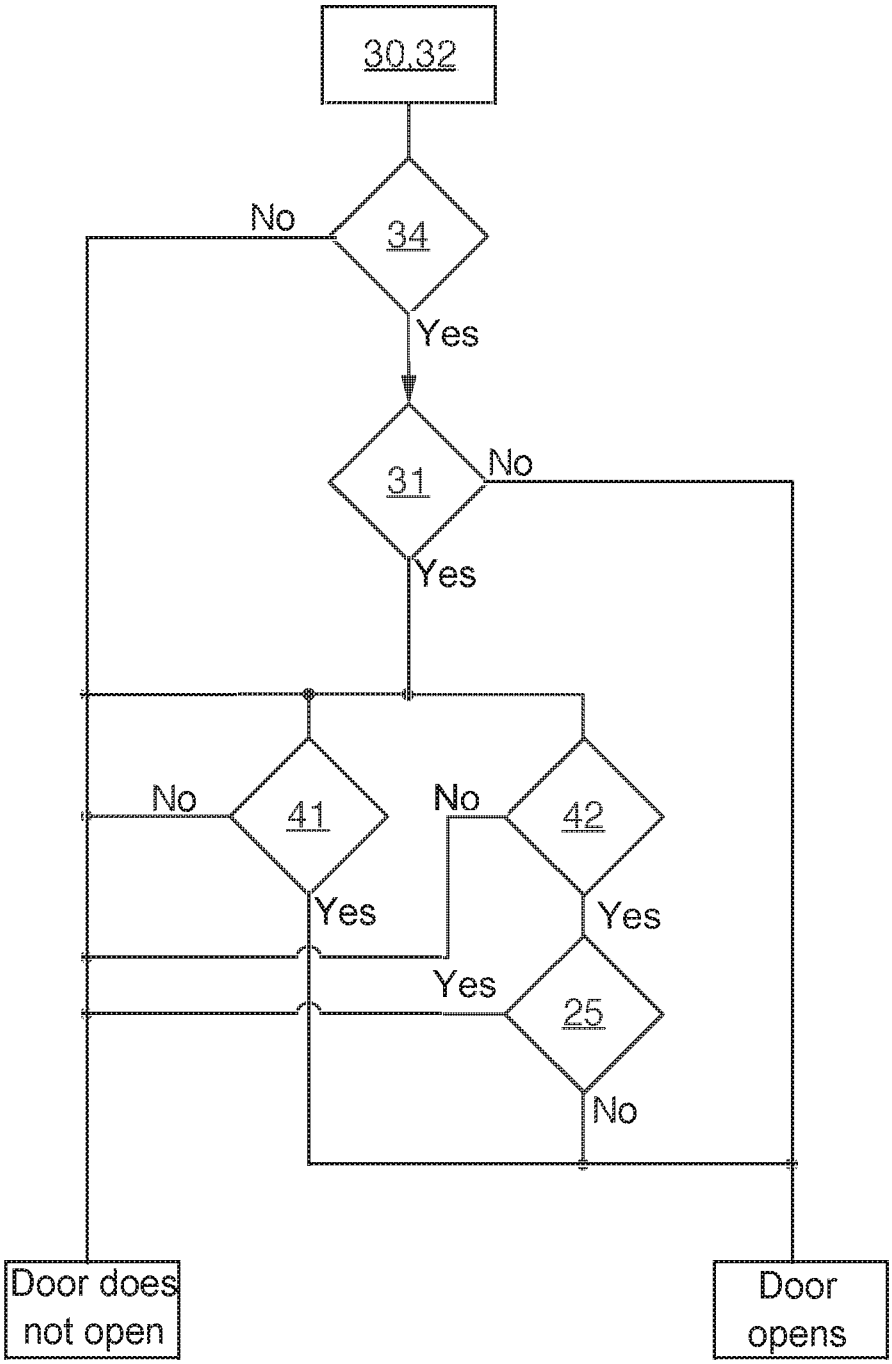

The following are shown:

FIG. 1 an electrically operable motor vehicle latch according to the state of the art, FIG. 2 the top view of an electrically operable motor vehicle lateral door latch according to an embodiment of the invention, FIG. 3 a flow diagram to illustrate operation of an internal operating lever on a motor vehicle lateral door latch according to the state of the art, and FIG. 4 a flow diagram for opening of a lateral door by means of an internal operating lever for the electrical opening of the door according to the invention.

In FIG. 1 a class-specific motor vehicle latch is reproduced according to the state of the art. A triggering lever 1 is pivotably accommodated around an axis 2. The triggering lever 1 is impelled by an electromotor 3 and a drive pulley 4 in the direction of the arrow so that a locking mechanism can be unlocked. An operating lever 5 is also pivotably accommodated around the axis 2 coaxially with the triggering lever 1. The operating lever 5 can be coupled with the bolting lever 10 by means of the coupling lever 6. The coupling lever 6 also interacts with the child safety element 14.

If the motor vehicle latch is now bolted and the child safety device engaged, an occupant of the motor vehicle cannot unbolt the latch in the closed state and thus cannot open the door. In particular in the case in which the motor vehicle latch has a cinching drive, the motor vehicle door should be able to be opened during electrical cinching by means of the internal door handle or the internal operating lever. The child safety device must be deactivated for this purpose. Deactivation can occur temporarily, for example, by means of an electromotor not illustrated in FIG. 1 and directly acting on the child safety element.

In FIG. 2, a motor vehicle door latch 21 according to the invention is reproduced in principle. The motor vehicle door latch 21 has a locking mechanism 22 consisting of a pawl 23 and a catch 24. A locking mechanism sensor 25 interacts directly with the catch 24. As can be recognized, the position of the catch 24 is queried or detected by means of the locking mechanism sensor 25 directly. A triggering lever 28 can be operated by means of an electrical drive 26 and a drive pulley 27. The triggering lever 28 is thus able to unlock the locking mechanism 22. By means of a child safety device 29 the motor vehicle latch 21 can be disabled by means of an internal door handle 30 in such a way that the locking mechanism 22 cannot be unlocked. Whether the child safety device 29 is engaged or not, i.e. activated or deactivated, can be recorded by the child safety sensor 31.

A non-illustrated cinching drive acts directly on the locking mechanism 22, in particular on the catch 24, and is able to transfer the locking mechanism 22 from a pre-ratchet position into a main ratchet position. In the main ratchet position of the locking mechanism 22 the catch 24 can activate the locking mechanism sensor 25, for example.

By means of an operating lever 32 a first wake-up switch 33 and an opening switch 34 can be operated. The operating lever 32 can be coupled with the bolting lever 36 by means of a coupling lever 35. A tappet 37 acts between the child safety device 29 and on the bolting device 36 and the coupling lever 35.

The switching elements 25, 31, 33, 34, 38 and 39 contained in the motor vehicle latch 21 are connected to a control unit 40 as indicated with the dot-dashed lines. The interplay or the engagement of the switching means 25, 31, 33, 34, 38 and 39 during operation of the internal operating lever 30 during cinching in cooperation with the control unit 40 is reproduced in the following flow diagrams.

FIG. 3 shows a flow diagram for opening of a lateral door and in particular a rear lateral door, in an operation of the internal door handle 30 and thus the operating lever 32.

If the internal door handle 30 and thus the operating lever 32 move, the opening switch 34 is thus operated, whereby the wake-up switch 33 in particular is operated initially. If the opening switch is not operated, the door thus does not open. If the opening switch 34 was operated on the contrary, a further querying occurs in respect of whether the child safety sensor 31 is activated or deactivated.

If the child safety switch was not activated, the door can thus be opened in an electrically operated manner. If the child safety switch was activated and thus the child safety device is engaged, a first query occurs as to whether by means of a release switch 41 the child safety device 29 was temporarily switched off. A temporary switch-off of the child safety sensor can occur by the driver of the vehicle, for example. If no temporary switch-off of the release switch occurred, the door is therefore not opened. If the release switch 41 was operated on the contrary, the door can thus be opened which can be found in the flow diagram in the lower right box.

If a cinching process 42 occurs after querying the child safety sensor 31 the door should be able to be opened by means of the internal door handle 30. The child safety device 29 therefore needs to be deactivated mechanically. The mechanical deactivation, for example, with an electrical drive is reproduced with the box 43 in the flow diagram. The door can then be opened. As an example, it is referred to that according to the query of the cinching 42 the door can then not be opened by means of the internal door handle 30 if the cinching process is not activated. FIG. 3 thus shows that a mechanical drive is required for the child safety device 29 to open the door by means of the internal door handle 30 during cinching.

FIG. 4 shows a flow diagram in which the locking mechanism sensor 25 is incorporated into the query for controlling the operating lever 32 during cinching of the locking mechanism 22. After operation of the internal door handle 30 and thus the operating lever 32 activation of the opening switch 34 takes place initially and the query as to whether the opening switch 34 was operated or not. If the opening switch 34 was operated, the control queries whether the child safety sensor 31 was activated or is deactivated.

If the child safety catch 29 is engaged, two alternative routes are thus possible. On the one hand, the release switch 41 can have been operated so that the door can be opened. And, on the other hand, a query occurs as to whether the cinching 42 lasts or is not activated. If the cinching 42 is in progress, i.e. the locking mechanism is usually transferred from a pre-ratchet position into a main ratchet position in an electrically operated manner a further query of the locking mechanism sensor 25 thus occurs as to whether the locking mechanism 22 is already completely locked, i.e. is located in the main ratchet.

If the locking mechanism 22 is not yet in the main ratchet position, the cinching 42 continues and the door can be opened by means of the internal door handle 30 or the operating lever 32. The locking mechanism sensor 25 is queried for querying as to whether the locking mechanism 22 is already in the main ratchet position. The location of the catch 24 or the pawl 23 can be queried, detected and/or recorded, for example, by means of the locking mechanism sensor according to how many sensors 25 or what type of sensors 25 are used. Thus, according to the invention, mechanical deactivation of the child safety device 29 can be dispensed with. The electrical drive for the child safety device 29 can thus be omitted.

LIST OF REFERENCE SYMBOLS

1 Triggering lever
2 Axis
3 Electromotor
4 Drive pulley
5 Operating lever
6 Coupling lever
10 Locking lever
14 Child safety element
21 Motor vehicle latch
22 Locking mechanism
23 Pawl
24 Catch
25 Locking mechanism sensor
26 Electrical drive
27 Drive disk
28 Triggering lever
29 Child safety device
30 Internal door handle
31 Child safety sensor
32 Operating lever
33 Wake-up switch
34 Opening switch
35 Coupling lever
36 Locking lever
37 Tappet
38, 39 Sensor
40 Control unit
41 Release switch
42 Cinching device
43 Electrical deactivation of the child safety device

The invention claimed is:

1. A motor vehicle latch comprising:
a locking mechanism for a motor vehicle door,
an electrical drive, whereby the locking mechanism can be unlocked by the electrical drive,
a child safety lock device with a child safety sensor, and
a cinching drive configured to move the locking mechanism from a pre-ratchet position into a main ratchet position,
a locking mechanism sensor corresponding to the locking mechanism,
an operating lever,
at least one operating switch that is operated by the operating lever, and
a control unit configured to:
query a switching position of the at least one operating switch,
query a switching position of the child safety sensor if the at least one operating switch is activated,
query the cinching device if the child safety sensor is activated,
query a switching position of the locking mechanism sensor if the cinching device is activated, and
open the motor vehicle door if the locking mechanism sensor is deactivated,
wherein the control unit is further configured to activate the electrical drive based on the switching positions of the child safety sensor and the locking mechanism sensor.

2. The motor vehicle latch according to claim 1, wherein the locking mechanism sensor is configured to detect whether the locking mechanism is in the pre-ratchet position or the main ratchet position.

3. The motor vehicle latch according to claim 1, wherein the locking mechanism includes a catch and wherein the locking mechanism sensor is arranged on the catch.

4. The motor vehicle latch according to claim 1 further comprising a triggering lever that is engageable with the locking mechanism and a coupling lever for coupling the operating lever with the triggering lever.

5. The motor vehicle latch according to claim 4 further comprising a bolting lever configured to move the coupling lever.

6. The motor vehicle latch according to claim 4 further comprising an internal operating lever, wherein the child safety device interacts with the coupling lever whereby the child safety device and the internal operating lever can be uncoupled.

7. The motor vehicle latch according to claim 1, wherein an internal operating lever and an external operating lever are accommodated coaxially.

8. The motor vehicle latch according to claim 1, wherein the operating lever and a triggering lever are accommodated coaxially.

9. The motor vehicle latch according to claim 1 further comprising a wake-up switch that is operated by the operating lever.

10. The motor vehicle latch according to claim 1 further comprising a release switch for switching off the child safety device.

11. The motor vehicle latch according to claim 8, wherein the triggering lever is engageable with the electrical drive for unlocking the locking mechanism.

12. The motor vehicle latch according to claim 1 further comprising a coupling lever, a triggering lever for unlocking the locking mechanism, an internal operating lever engageable with the triggering lever, and an external operating lever engageable with the triggering lever.

13. The motor vehicle latch according to claim 12, wherein the coupling lever has a first position in which the coupling lever couples the internal operating lever and the external operating lever with the triggering lever, a second position in which the external operating lever is disengaged from the triggering lever, and a third position in which both the external operating lever and the internal operating lever are disengaged from the triggering lever.

14. The motor vehicle latch according to claim 13, wherein the child safety device is engageable with the coupling lever for uncoupling the internal operating lever from the triggering lever.

* * * * *